US011808027B2

(12) United States Patent
Zail

(10) Patent No.: US 11,808,027 B2
(45) **Date of Patent: *Nov. 7, 2023**

(54) ADJUSTABLE LIVING SPACE

(71) Applicant: Impact Urban, LLC, Mill Valley, CA (US)

(72) Inventor: Nolan Zail, Mill Valley, CA (US)

(73) Assignee: Impact Urban, LLC, Mill Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/748,439

(22) Filed: May 19, 2022

(65) Prior Publication Data

US 2022/0275631 A1 Sep. 1, 2022

Related U.S. Application Data

(63) Continuation of application No. 17/084,015, filed on Oct. 29, 2020, now Pat. No. 11,377,842.

(51) Int. Cl.

| | |
|---|---|
| ***E04B 1/343*** | (2006.01) |
| ***E04B 1/344*** | (2006.01) |
| *E04H 1/02* | (2006.01) |
| *E04H 3/02* | (2006.01) |

(52) U.S. Cl.

CPC ..... *E04B 1/3431* (2013.01); *E04B 1/3445* (2013.01); *E04H 1/02* (2013.01); *E04H 3/02* (2013.01)

(58) Field of Classification Search

CPC ..... E04B 1/3431; E04H 1/125

See application file for complete search history.

(56) References Cited

U.S. PATENT DOCUMENTS 1,045,854 A * 12/1912 Kevitt et al. ..... E04B 1/3445 297/42
3,042,978 A 7/1962 Eames et al.
3,141,207 A 7/1964 Kahler
3,226,778 A 1/1966 Kollsman et al.
3,235,915 A 2/1966 Glaser (Continued)

FOREIGN PATENT DOCUMENTS

CA 2891004 6/2014
FR 3081480 11/2019

(Continued)

OTHER PUBLICATIONS

International Search Report and Written Opinion dated Feb. 7, 2022 in International Patent Application No. PCT/US2021/055904.

(Continued)

*Primary Examiner* — Christine T Cajilig
(74) *Attorney, Agent, or Firm* — Vierra Magen Marcus LLP

(57) ABSTRACT

A living space is disclosed including one or more adjustable or reconfigurable rooms. A room may be made reconfigurable by including fixed walls and a frame that is mounted to move in a first direction between a first position coextensive with the fixed walls and a second position that is extended relative to the fixed walls. The room may further include panels mounted in the frame configured to move in a second direction, orthogonal to the first direction, to seal off a front of the room. In examples, the panels may store against the frame when not in use.

22 Claims, 16 Drawing Sheets

(56) References Cited

U.S. PATENT DOCUMENTS

| | | | | |
|---|---|---|---|---|
| 4,074,475 | A * | 2/1978 | Wahlquist | E04B 1/3445 52/143 |
| 5,601,348 | A | 2/1997 | Minkovski | |
| 6,128,875 | A | 10/2000 | Quaintance | |
| 6,405,491 | B1 | 6/2002 | Gallant | |
| 6,463,701 | B1 * | 10/2002 | Baloga | G09F 15/0068 160/214 |
| 6,681,529 | B1 * | 1/2004 | Baloga | G09F 7/08 160/214 |
| 7,454,868 | B2 | 11/2008 | Clark | |
| 9,084,489 | B2 | 7/2015 | Gosling et al. | |
| 9,222,255 | B2 * | 12/2015 | Johnson | E04B 1/343 |
| 9,382,749 | B2 | 7/2016 | George et al. | |
| 2005/0086876 | A1 | 4/2005 | Clark | |
| 2012/0318467 | A1 | 12/2012 | Levin | |
| 2015/0247338 | A1 | 9/2015 | Woodroffe | |
| 2016/0051441 | A1 * | 2/2016 | Perovic | A61H 33/066 4/526 |
| 2016/0069062 | A1 * | 3/2016 | Dynon | E04B 1/3444 52/79.5 |
| 2017/0159316 | A1 * | 6/2017 | Soukos | E04B 1/08 |
| 2018/0258635 | A1 | 9/2018 | Birsel et al. | |
| 2020/0095787 | A1 * | 3/2020 | Van Aukee | E04B 1/34347 |
| 2020/0347626 | A1 * | 11/2020 | Petty | E04B 1/34357 |

FOREIGN PATENT DOCUMENTS

| | | |
|---|---|---|
| KR | 102037312 | 10/2019 |
| WO | 8905389 | 6/1989 |

OTHER PUBLICATIONS

Office Action dated Oct. 1, 2021 in U.S. Appl. No. 17/084,015.
Response to Office Action dated Jan. 3, 2022 in U.S. Appl. No. 17/084,015.
Notice of Allowance and Fee(s) Due dated Feb. 14, 2022 in U.S. Appl. No. 17/084,015.
Final Office Action dated Apr. 1, 2022 in U.S. Appl. No. 17/084,015.
Response to Final Office Action dated Apr. 20, 2022 in U.S. Appl. No. 17/084,015.
Notice of Allowance and Fee(s) Due dated May 16, 2022 in U.S. Appl. No. 17/084,015.

* cited by examiner

ADJUSTABLE LIVING SPACE

PRIORITY DATA

This application is a continuation of U.S. patent application Ser. No. 17/084,015, filed Oct. 29, 2020, entitled "ADJUSTABLE LIVING SPACE", which application is incorporated herein by reference in its entirety for all purposes.

BACKGROUND

In densely populated constructions such as dormitories, apartment buildings and hotels, space is at a premium in order to maximize the number of units that can be provided within the construction. Traditionally, this has resulted in units in which both the communal living rooms and bedrooms have a small footprint. Moreover, these units have included fixed walls, where optimizing the size of one room or area comes at the expense of the size of another room or area.

More recently, it has become known to provide internal walls that are capable of moving in one direction to allow the size of a room to be dynamically changed. However, such systems have been complicated and expensive and, as such, not successfully implemented.

DETAILED DESCRIPTION

The present technology will now be described with reference to the figures, which in embodiments, relate to an adjustable or reconfigurable living space where one or more walls of a room are easily movable in one or more orthogonal directions to provide a high degree of flexibility in the room configuration. Furniture within the room such as a bed and closet may also be easily moved in coordination with the room configuration.

It is understood that the present technology may be embodied in many different forms and should not be construed as being limited to the embodiments set forth herein. Rather, these embodiments are provided so that this disclosure will be thorough and complete and will fully convey the technology to those skilled in the art. Indeed, the technology is intended to cover alternatives, modifications and equivalents of these embodiments, which are included within the scope and spirit of the technology as defined by the appended claims. Furthermore, in the following detailed description of the present technology, numerous specific details are set forth in order to provide a thorough understanding of the present technology. However, it will be clear to those of ordinary skill in the art that the present technology may be practiced without such specific details.

The terms "longitudinal" and "transverse," "top" and "bottom," "upper" and "lower" and "vertical" and "horizontal," and forms and synonyms thereof, as may be used herein are by way of example and illustrative purposes only, and are not meant to limit the description of the technology inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±2.5% of a given dimension.

Figure 1:
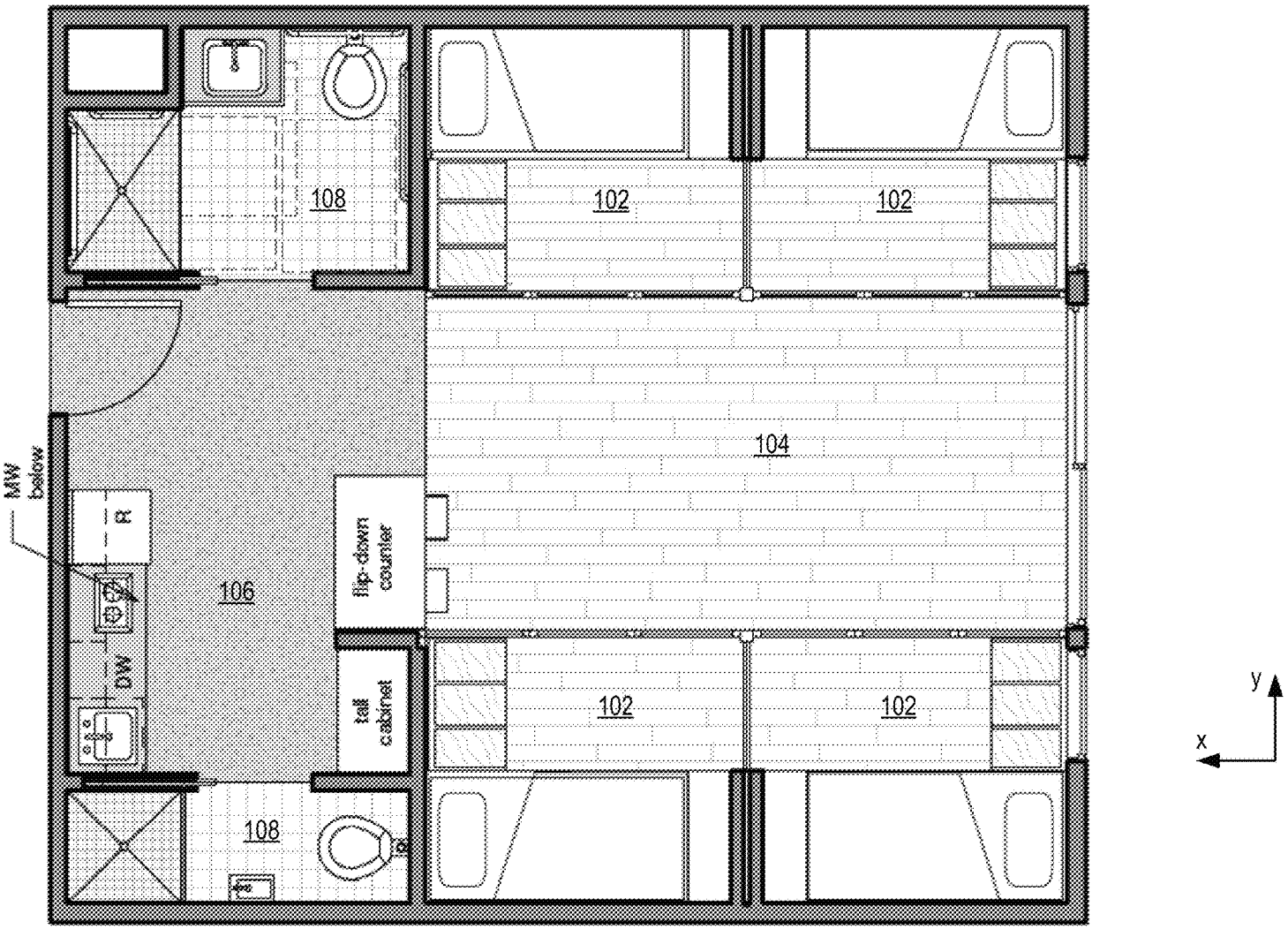
FIG. 1 is a plan view of a living space according to embodiments of the present technology including a number of first rooms such as bedrooms, a communal area, a kitchen and bathrooms.

An embodiment of the present technology will now be explained with reference to the plan and perspective views of FIGS. 1-22. FIG. 1 is a plan view of a living space including one or more rooms that are reconfigurable in accordance with the present technology. In the embodiment shown, the living space 100 includes four rooms 102, a communal area 104, a kitchen 106 and bathrooms 108. It is understood that the living space 100 may have a variety of other configurations in further embodiments, including more or less rooms 102, multiple communal areas 104, more or no kitchens 106 and/or more, one or no bathrooms 108. In one such example, the living space 100 may simply include a room 102 which opens to a communal area 104. The living space 100 may be a single, stand-alone flat, or may be part of a construction including multiple living spaces (such other living spaces being conventional or configured according to the present technology). In embodiments, the living space 100 may be part of an apartment building, a dormitory, a hotel, motel or hostel, an office, a hospital, a library, a showroom, a store or other construction. Such structures may initially be constructed with reconfigurable spaces according to the present technology, or such structures may be modified after their initial construction to include reconfigurable spaces according to the present technology. In embodiments described below, the living space 100 may include a bed and other components. However, in further embodiments, the living space 100 may be configured with a desk and other office components for inclusion within an office. This is still considered a living space as used herein.

In embodiments described below, the room 102 may be a bedroom, but may be any of a variety of other rooms in further embodiments, including a communal area, a kitchen, a bathroom, a den, a living room, a work or other space within an office, or any other type of room found in a construction. The furniture described below within room 102 may be altered depending on the type of room 102.

Figure 2:
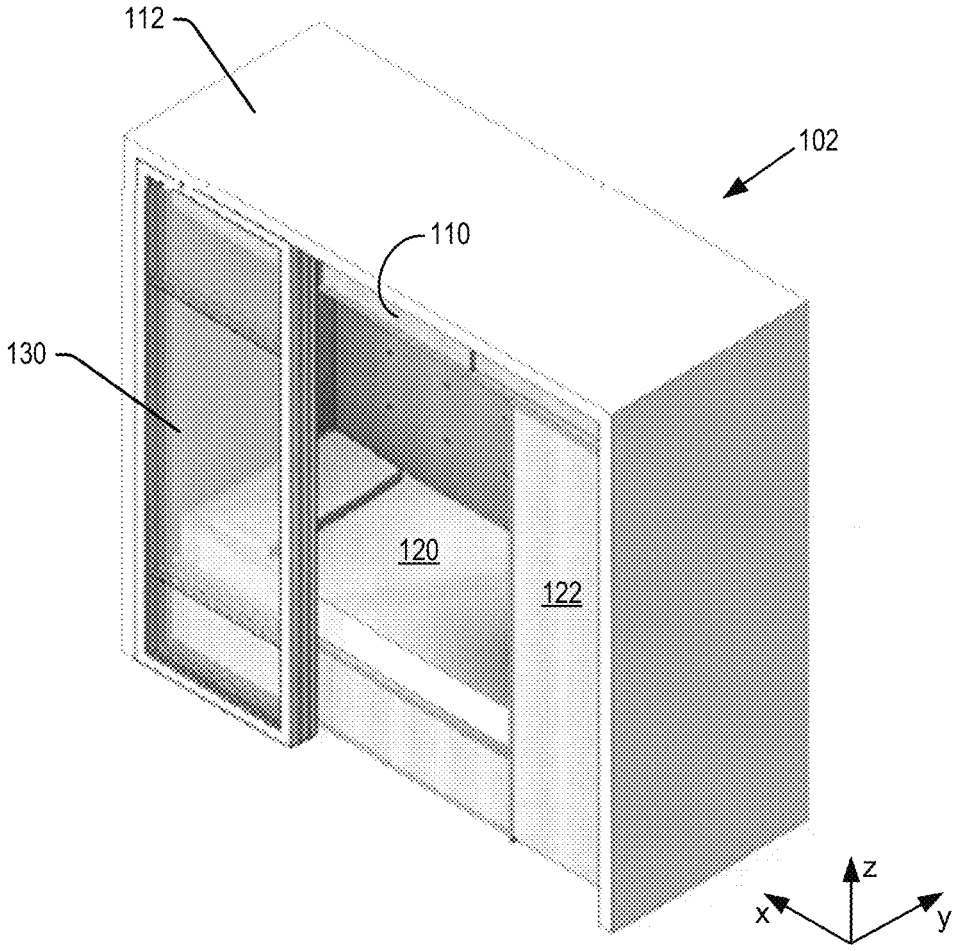
FIGS. 2 and 3 are perspective and plan views of a configuration of a room according to the present technology, with a frame in a retracted position and panels in an open position.
Figure 3:
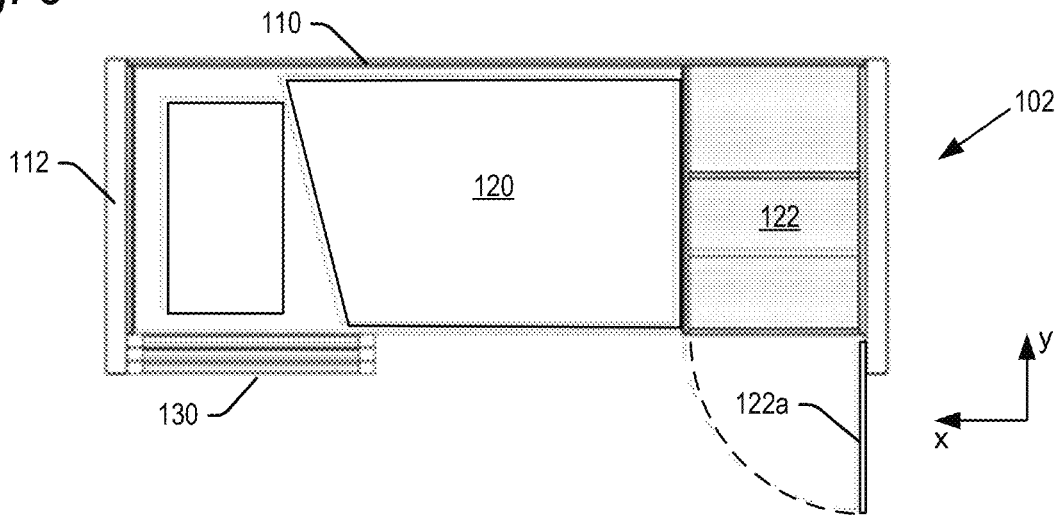

FIGS. 2 and 3 are perspective and plan views, respectively, of one embodiment of a room 102 in accordance with the present technology. In the embodiment shown, walls of room 102 are collapsed or retracted in the transverse direction (i.e., along the y-axis) to provide a configuration where room 102 has its minimum footprint. In particular, room 102 comprises an interior form factor defined by a set of interior walls 110 having a fixed configuration, and a frame 112 that surrounds the interior walls 110 on three sides (the top section of the frame 112 is not shown in FIG. 3 for clarity). The frame 112 is translationally mounted for movement along y-axis as explained below.

In FIGS. 2 and 3, the frame 112 is shown in its collapsed or retracted position, substantially or entirely over the interior walls 110. In this configuration, the frame 112 is said to be "coextensive" with interior walls 110. The frame 112 may have a depth along the y-axis direction that is the same as the depth of the interior walls 110. In further embodiments, the frame 112 may have a smaller depth than walls 110, or the frame 112 may have a depth that is larger than that of the interior walls, so as to extend out beyond the interior walls 110 when coextensive with the interior walls 110. The frame 112 may be located exteriorly to interior walls 110, so as to fit over walls 110 when in the retracted position as shown in FIGS. 2-7. Alternatively, the frame 112 may be located interiorly of the interior walls 110, so as to fit within the walls 110 when in the retracted position as shown in FIGS. 14-16 and 20-22.

Figure 4:
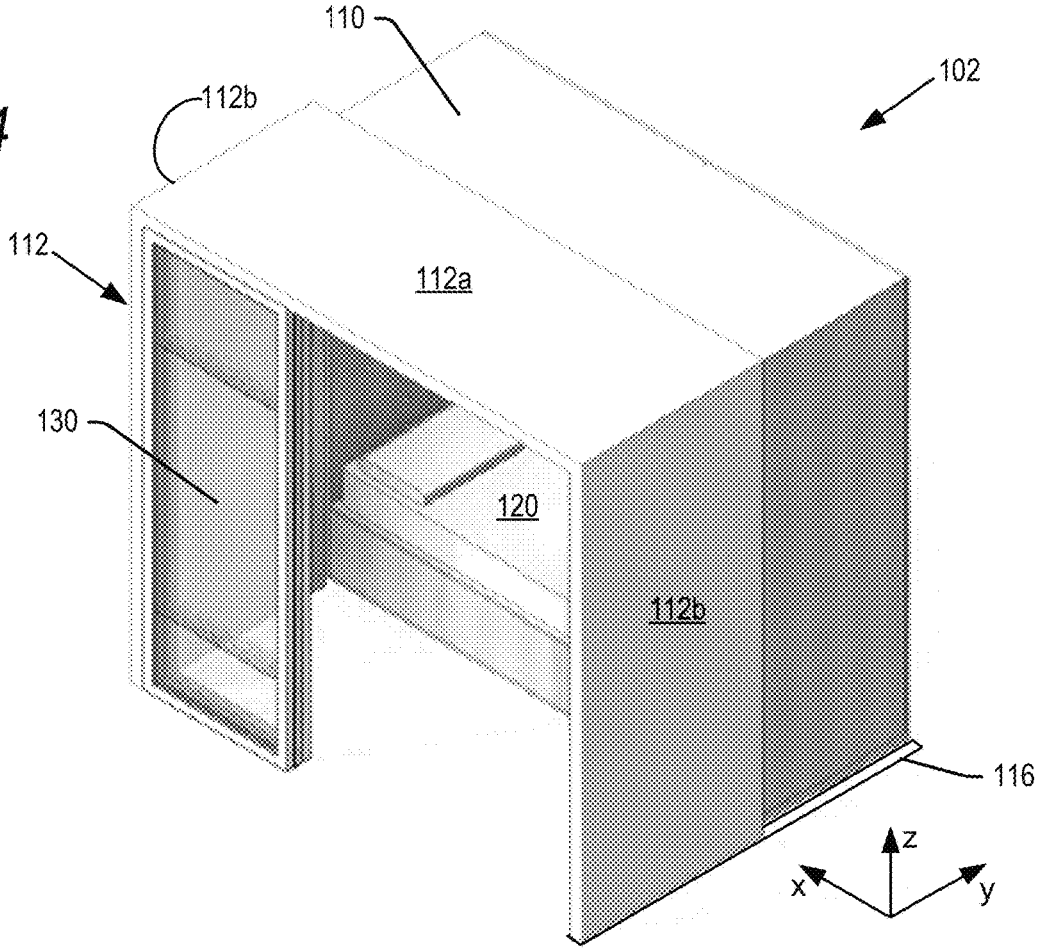
FIGS. 4 and 5 are perspective and plan views of a configuration of a room according to the present technology, with a frame in an extended position and panels in an open position.
Figure 5:
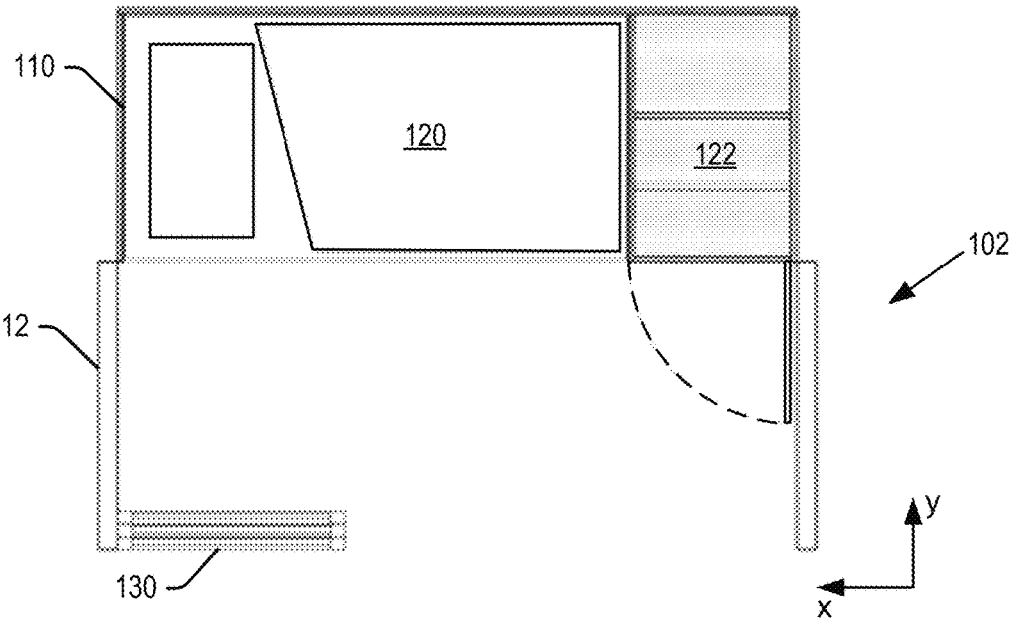

FIGS. 4 and 5 are perspective and plan views, respectively, of the embodiment of FIGS. 2 and 3, with the frame 112 extended along the y-axis to enlarge an area, or form factor, of room 102. Frame 112 may comprise a top horizontal section 112*a* and a pair of downwardly extending vertical sections 112*b*. Again, the top 112*a* of frame 112 is omitted from FIG. 5 for clarity. Frame 112 may be formed from any of a variety of rigid materials including for example natural, composite or engineered lumber, laminated particleboard, and various plastics or metals. Its thickness may vary, but in one embodiment may be ½ to 1½ inches. Other thicknesses are possible.

The downwardly extending vertical sections 112*b* may include rollers (not shown) on their bottom surfaces that ride within a track 116, partially shown in FIG. 4, on opposed sides of room 102. The track 116 guides the movement of frame 112 between its extended and retracted positions, and also limits the extent to which the frame can extend. In further embodiments, the track 116 may be omitted. In such embodiments, the rollers of frame 112 may glide along the floor and a catch (not shown) may be provided between the adjacent surfaces of the frame 112 and walls 110 to limit the extent to which the frame can extend.

In embodiments, room 102 may include a bed 120 and a cupboard 122 having a door 122*a* (FIG. 3) which swings outward. There may be furniture and components in room 102 instead of or in addition to bed 120 and cupboard 122, or there may be no furniture or components in room 102, in further embodiments. In further embodiments, the bed 120 may slide upward when not in use to free up space within room 102.

In the retracted position shown in FIGS. 2 and 3, room 102 as a minimum form factor, such as for example the width of bed 120 and cupboard 122, the length of the bed 120 and cupboard 122 together, and a height allowing a user to sit or stand within the room 122. This length, width and height of the minimum form factor may vary in embodiments. In the retracted position, the form factor of room 102 is minimized so as to provide more room for example in the communal area 104 (FIG. 1) which room 102 was adjacent.

On the other hand, where user wishes more space within the room 102, the user may move the frame 112 from its retracted position shown in FIGS. 2 and 3 to the extended position shown in FIGS. 4 and 5. In embodiments, this may effectively double the size within the room 102. The frame 112 may be manually moved between its retracted and extended positions shown in FIGS. 2-5. In further embodiments, the frame may be connected by gear or chain to a DC, stepper or other type of motor to automate the movement of frame 112 between its retracted and extended positions. In such embodiments, an activation switch may be provided within room 102.

Figure 6:
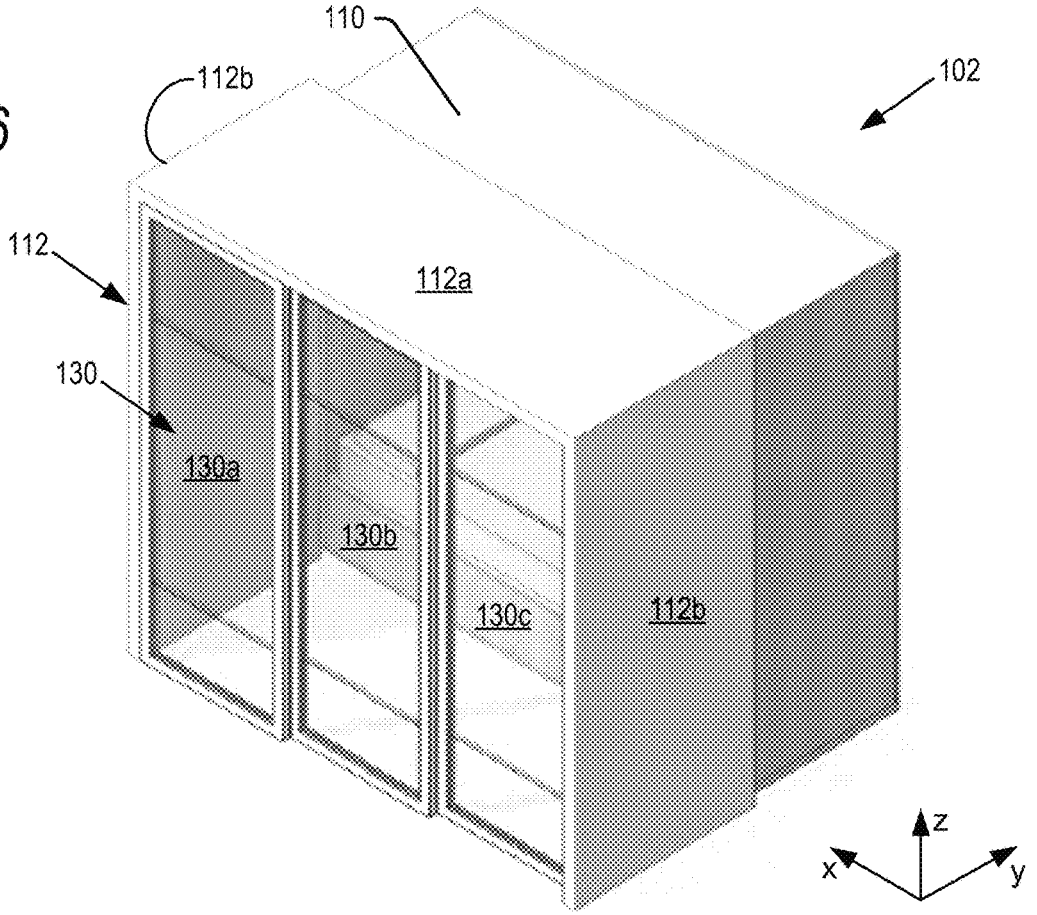
FIGS. 6 and 7 are perspective and plan views of a configuration of a room according to the present technology, with a frame in an extended position and panels in a closed position.
Figure 7:
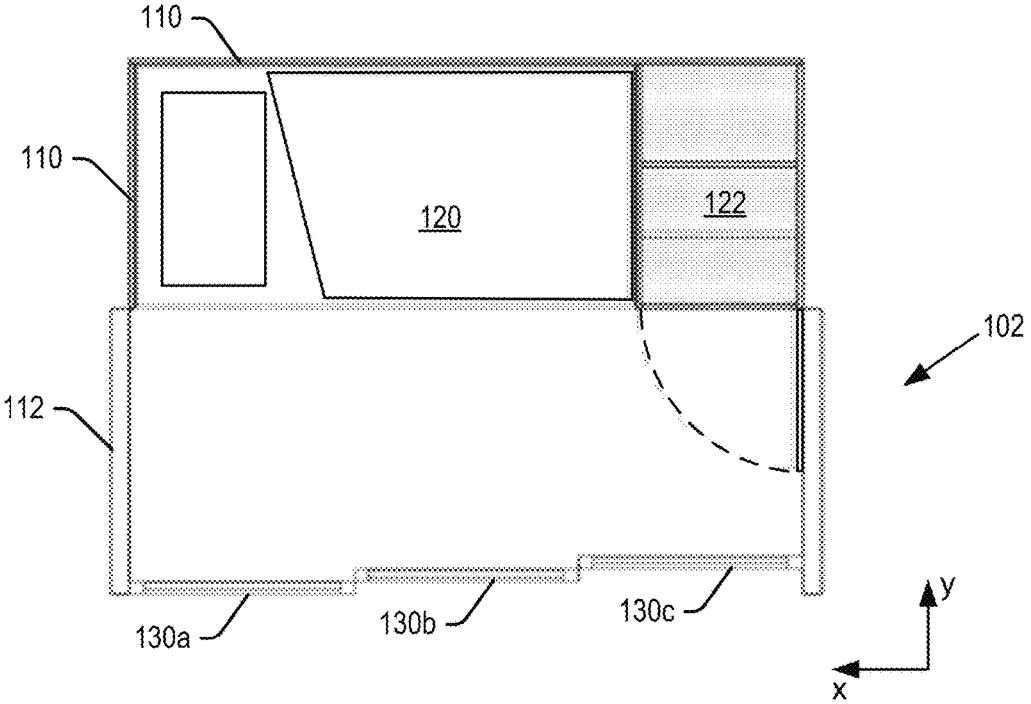

Referring now additionally to the perspective and plan views of room 102 shown in FIGS. 6 and 7, wall panels 130 may be supported on a front portion of frame 112 for enclosing the room 102. The wall panels 130 may be affixed at their upper end to a track (not shown in FIGS. 2-7) running along an underside of top horizontal section 112*a*. In embodiments, there are multiple wall panels 130*a*, 130*b* and 130*c*, though there may be more or less wall panels 130 in further embodiments. Each panel 130 may be mounted in distinct planes and on its own track within frame 112 so that the panels may retract behind each other (as shown in FIGS. 2 and 3) or extend to cover the front side of room 102 (as shown in FIGS. 6 and 7). The panels 130 may also be placed at any position between the open position shown in FIGS. 2 and 3 and the closed position shown in FIGS. 6 and 7. The panels 130 may be made to slide between the open and closed positions by a variety of mounting schemes other than being mounted on their own tracks.

Some or all of the panels 130 may be transparent (at least to some degree) as shown in FIG. 6. Alternatively, some or all of the panels may be opaque. In further embodiments the panels may include an electro-chromatic material to switch between transparency and an opaque state by applying a voltage. In such embodiments, a switch may be provided in room 102 to turn the panels transparent or opaque. The vertical edges of each panel 130 may fit snugly against each other when in the closed position shown in FIGS. 6 and 7 to minimize sound penetrating through panels 130. A strip of noise-cancelling material, such as an elastic strip, may be provided at the vertical edges of the panels to enhance the noise reduction.

In the open position shown in FIGS. 2 and 3, the panels 130 still close off part of the front of room 102. In further embodiments, the panels may be stowed against one of vertical frame sections 112*b* when in the open position so that the front of room 102 may be completely open. Such an embodiment will now be described with reference to FIGS. 8-22.

Figure 8:
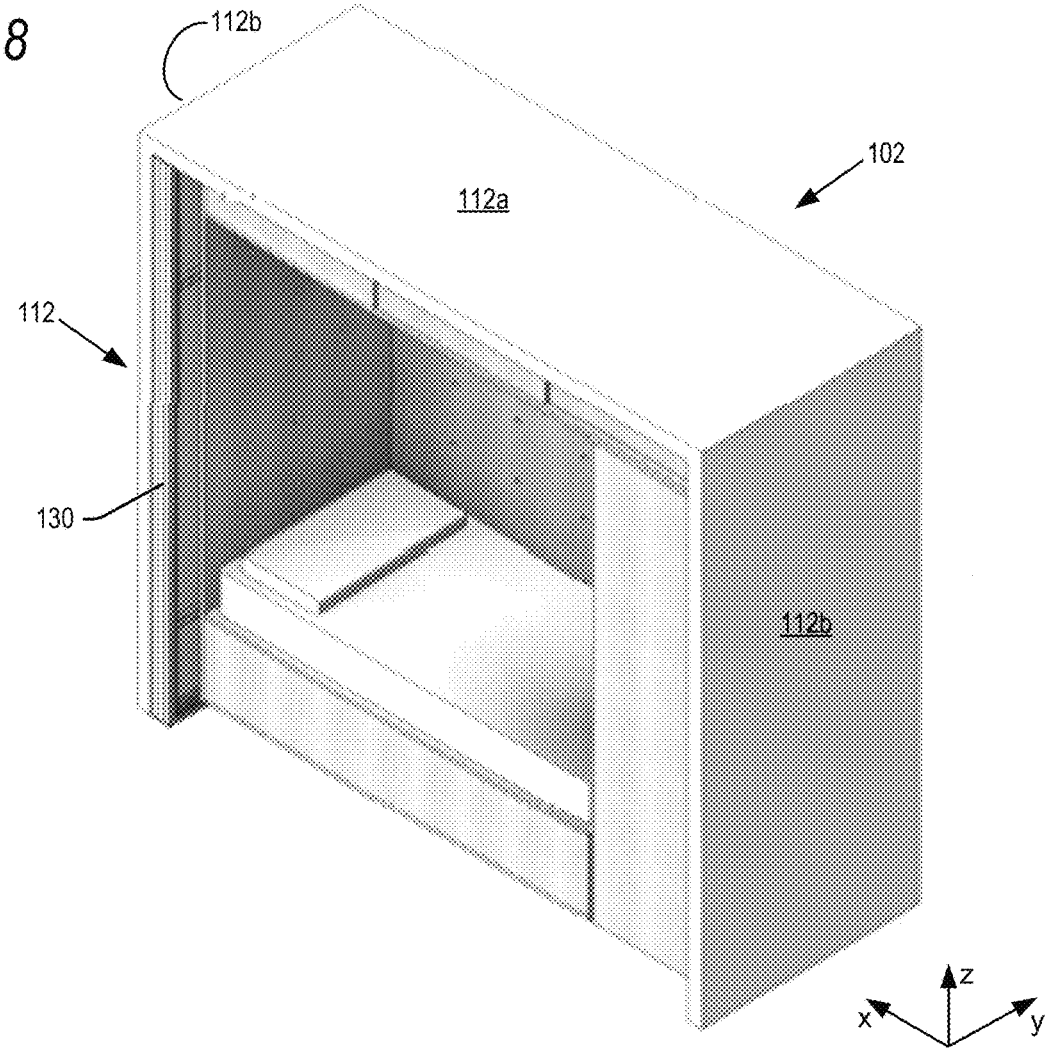
FIGS. 8 and 9 are perspective and plan views of a configuration of a room according to an alternative embodiment with the frame in a retracted position and the panels stowed against a vertical side section of the frame.
Figure 9:
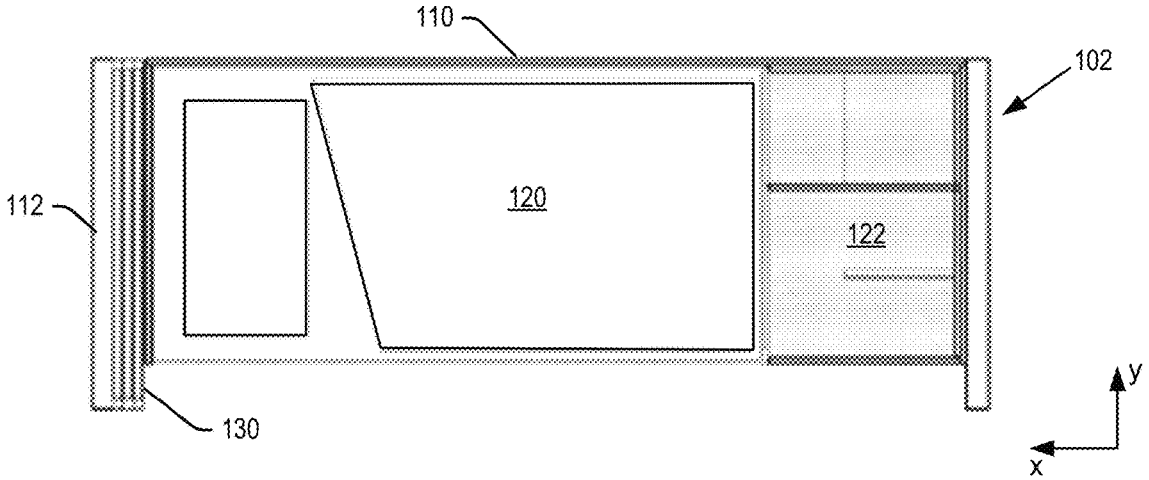

FIGS. 8 and 9 are perspective and plan views, respectively, of an alternative embodiment of the present technology where panels 130 store against one of the vertical frame sections 112*b*. In the views shown, the frame 112 is in its retracted position to minimize the form factor of room 102. As illustrated, the panels 130 may stow between cupboard 122 and vertical frame section 112*b*. The panels 130 may alternatively stow between bed 120 and a vertical frame section 112*b*, or more generally between a vertical interior wall section 110 and a vertical frame section 112*b*. In further embodiments (including three panels), two panels may stow against one of the vertical frame sections, such that they rotate outward and then one extends linearly, and one panel may stow against the other vertical frame section, such that it rotates outward. In an embodiment including for example four panels, two panels may stow against each of the vertical frame sections, such that the panels on both sides rotate outward and then one panel on each side extends linearly.

Figure 10:
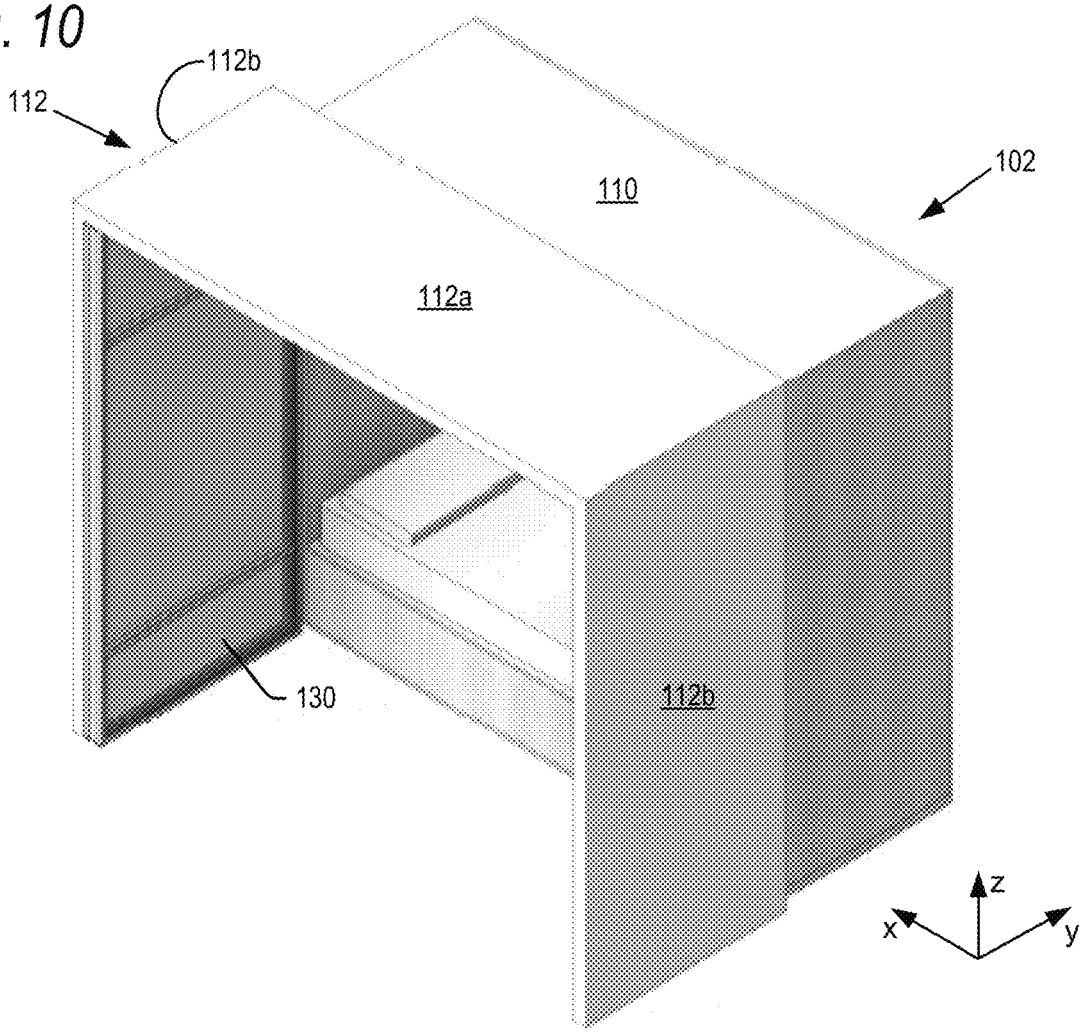
FIGS. 10 and 11 are perspective and plan views of a configuration of a room according to an alternative embodiment with the frame in an extended position and the panels stowed against a vertical side section of the frame.
Figure 11:
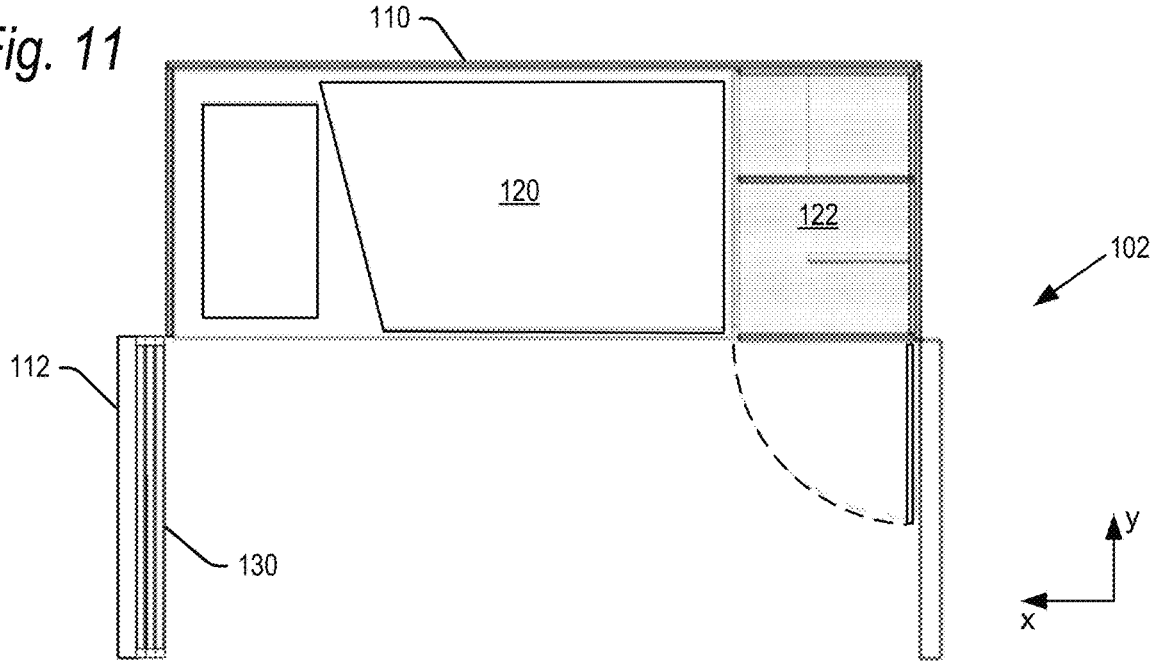

FIGS. 10 and 11 are perspective and plan views, respectively, showing frame 112 having been moved from its retracted position of FIGS. 8 and 9 to its extended position as described above. The top horizontal section 112*a* of frame 112 is omitted for clarity. As shown, the panels 130 remain stowed against a vertical section 112*b* as the frame 112 slides outward.

Figure 12:
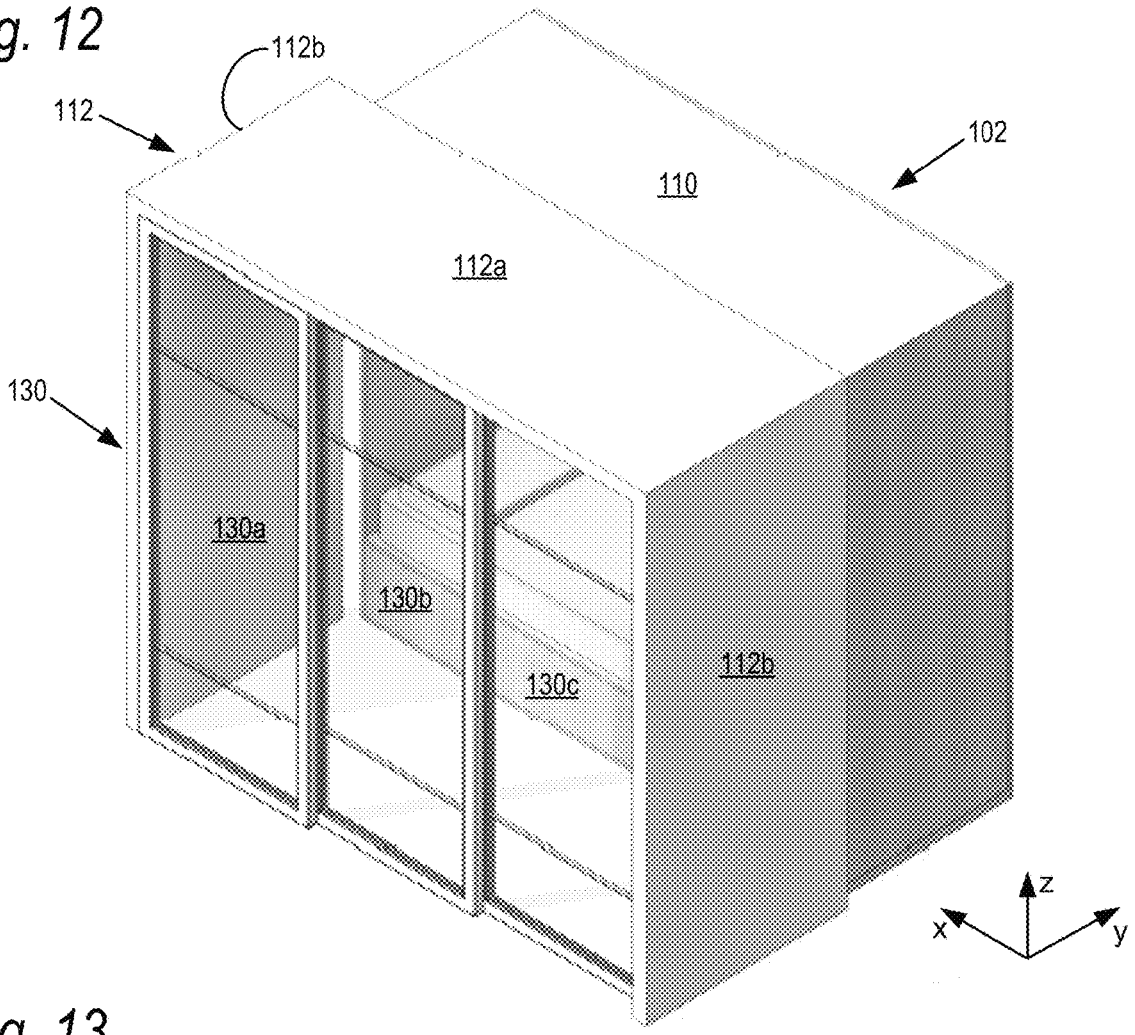
FIGS. 12 and 13 are perspective and plan views of a configuration of a room according to an alternative embodiment with the frame in an extended position and the panels rotated outward away from a vertical side section of the frame.
Figure 13:
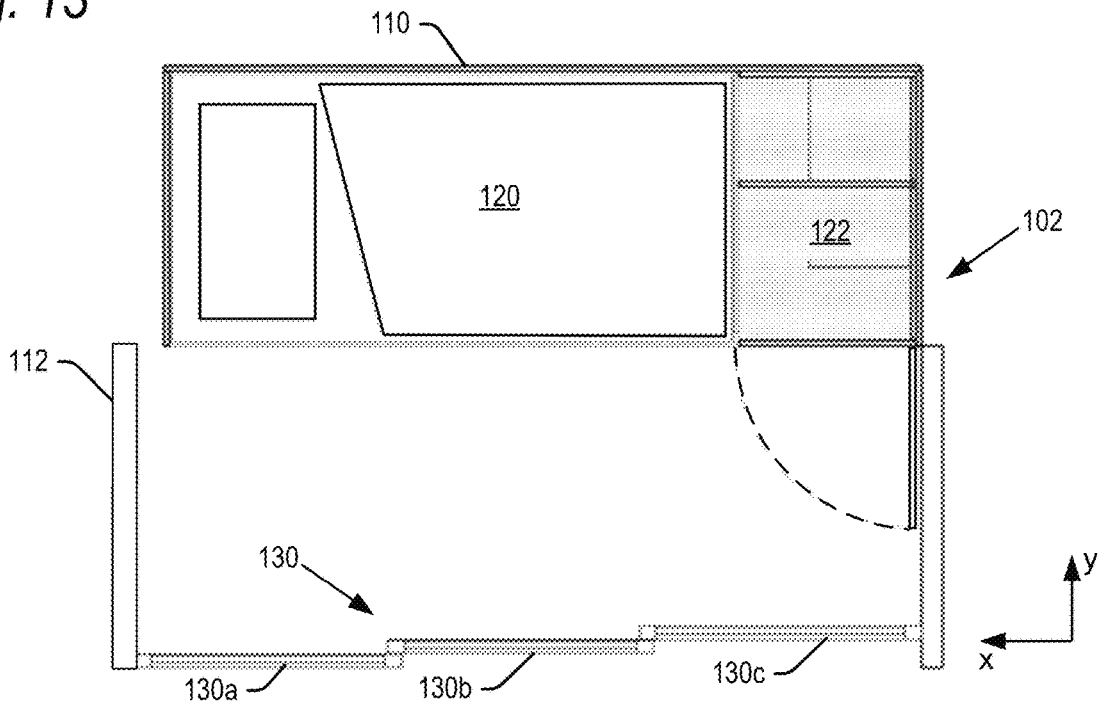
Figure 14:
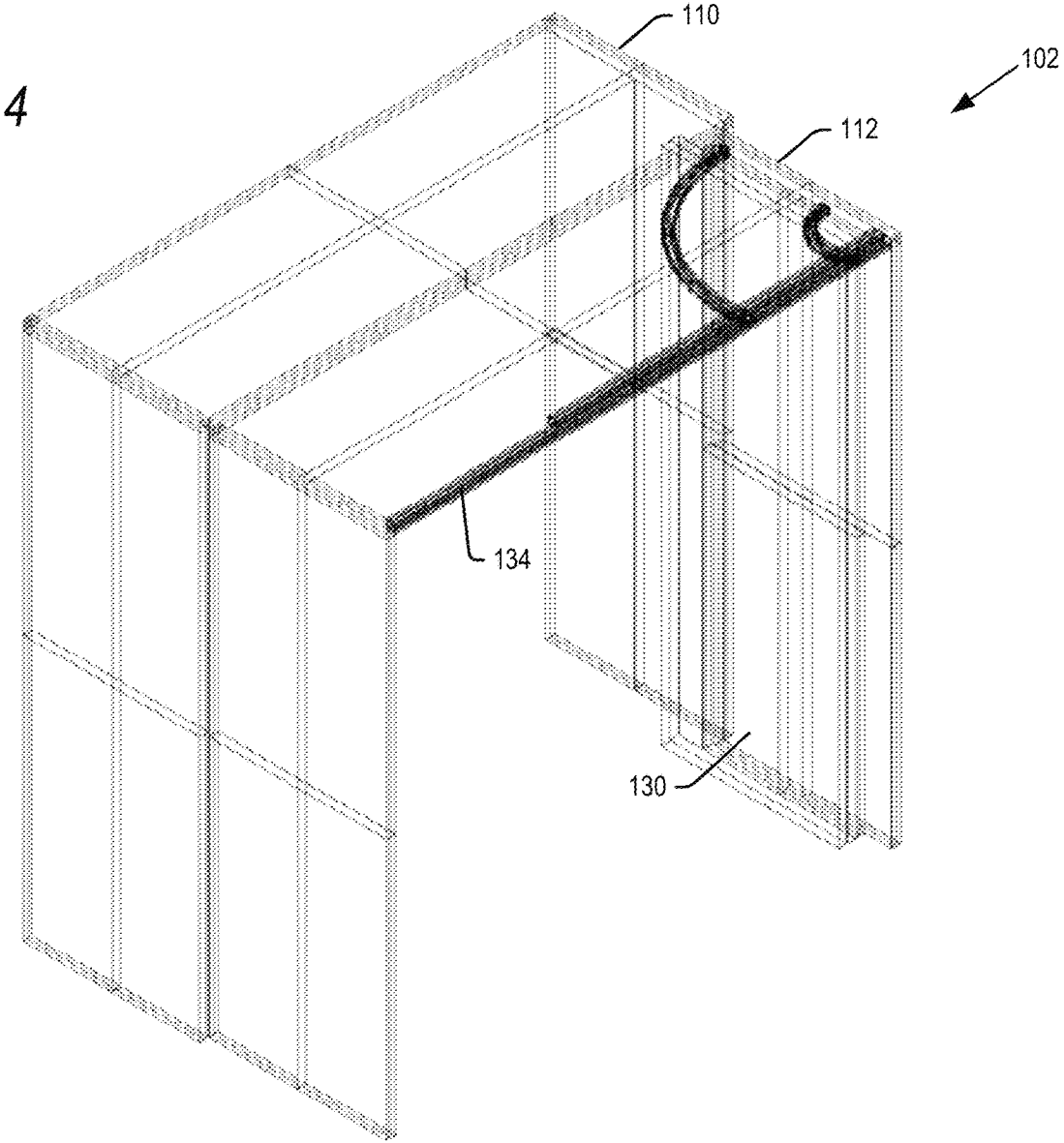
FIG. 14 is perspective view through the frame showing a track on which the panels are mounted.
Figure 15:
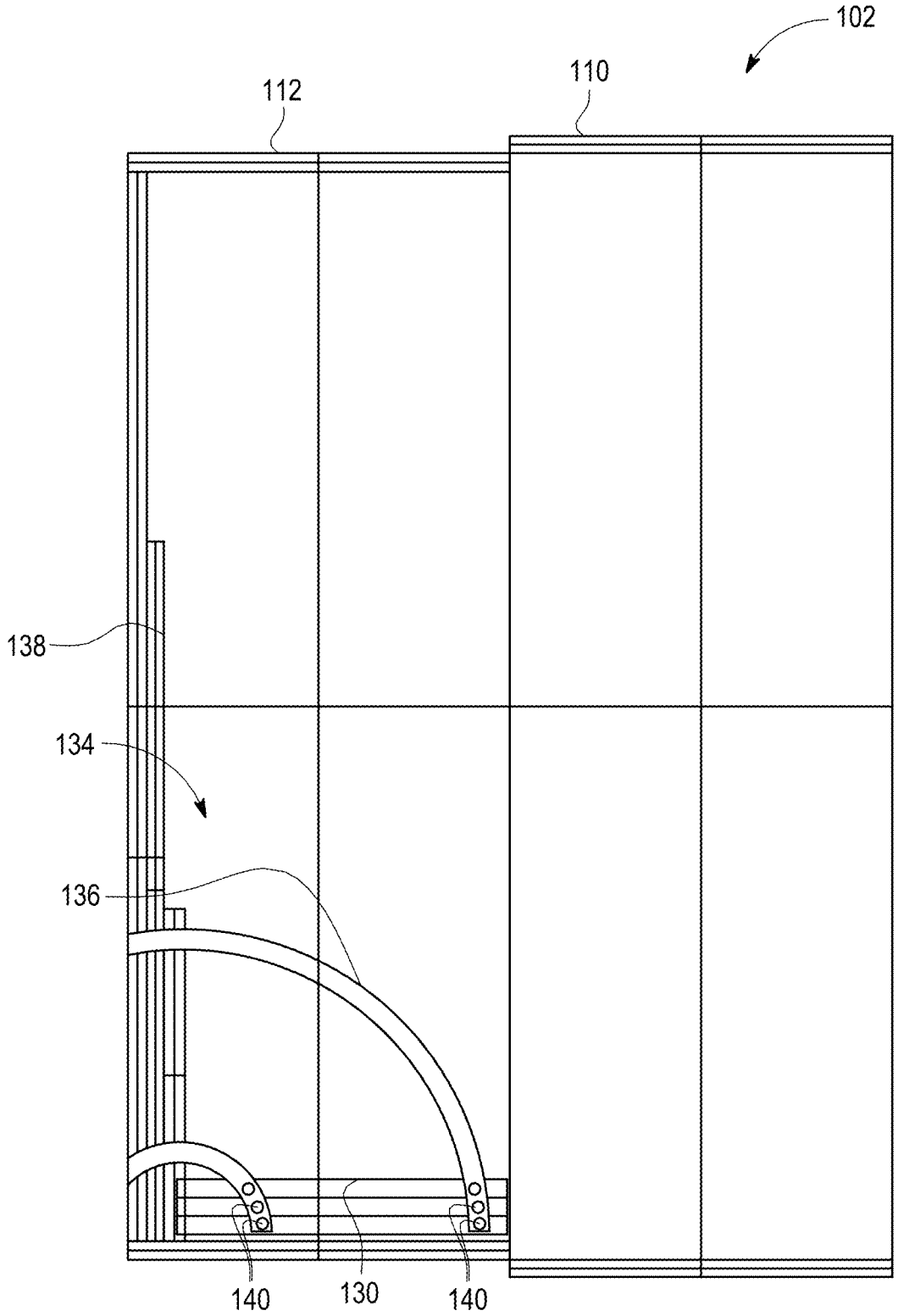
FIG. 15 is a plan view through the frame, showing the panels mounted in the track against a vertical sidewall of the frame.
Figure 16:
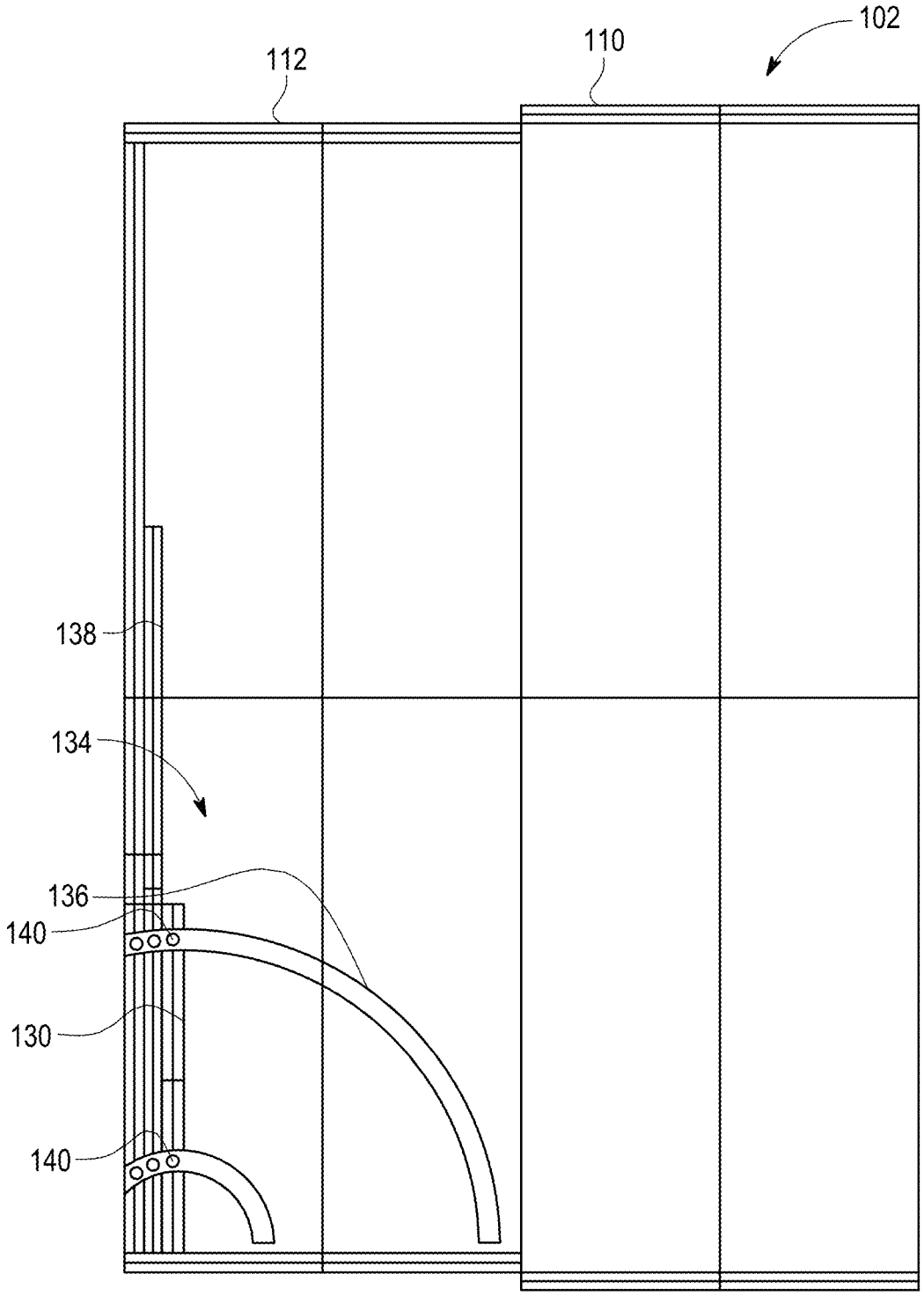
FIG. 16 is a plan view through the frame, showing the panels mounted in the track rotated away from a vertical sidewall of the frame.

FIGS. 12 and 13 are perspective and plan views, respectively, showing the panels 130 rotated outward 90° from their stowed position shown in FIGS. 10 and 11. FIGS. 14-16 are perspective and plan views through frame 112 that illustrate a track 134 within which panels 130 are mounted to support the panels 130 on frame 112. FIGS. 8-13 show the panels stowing against vertical section 112*b*, where FIGS. 14-22 show the panels stowing against vertical section 112*c*. Track 134 may consist of arcuate sections 136 and linear sections 138. In FIGS. 14 and 15, the panels 130 are shown mounted in track 134 in their stowed position in the arcuate sections 136, against vertical section 112*b*. In FIG. 16, the panels are shown mounted in track 134, in their extended position in linear sections 138, aligned with a front portion of the frame 112.

Figure 17:
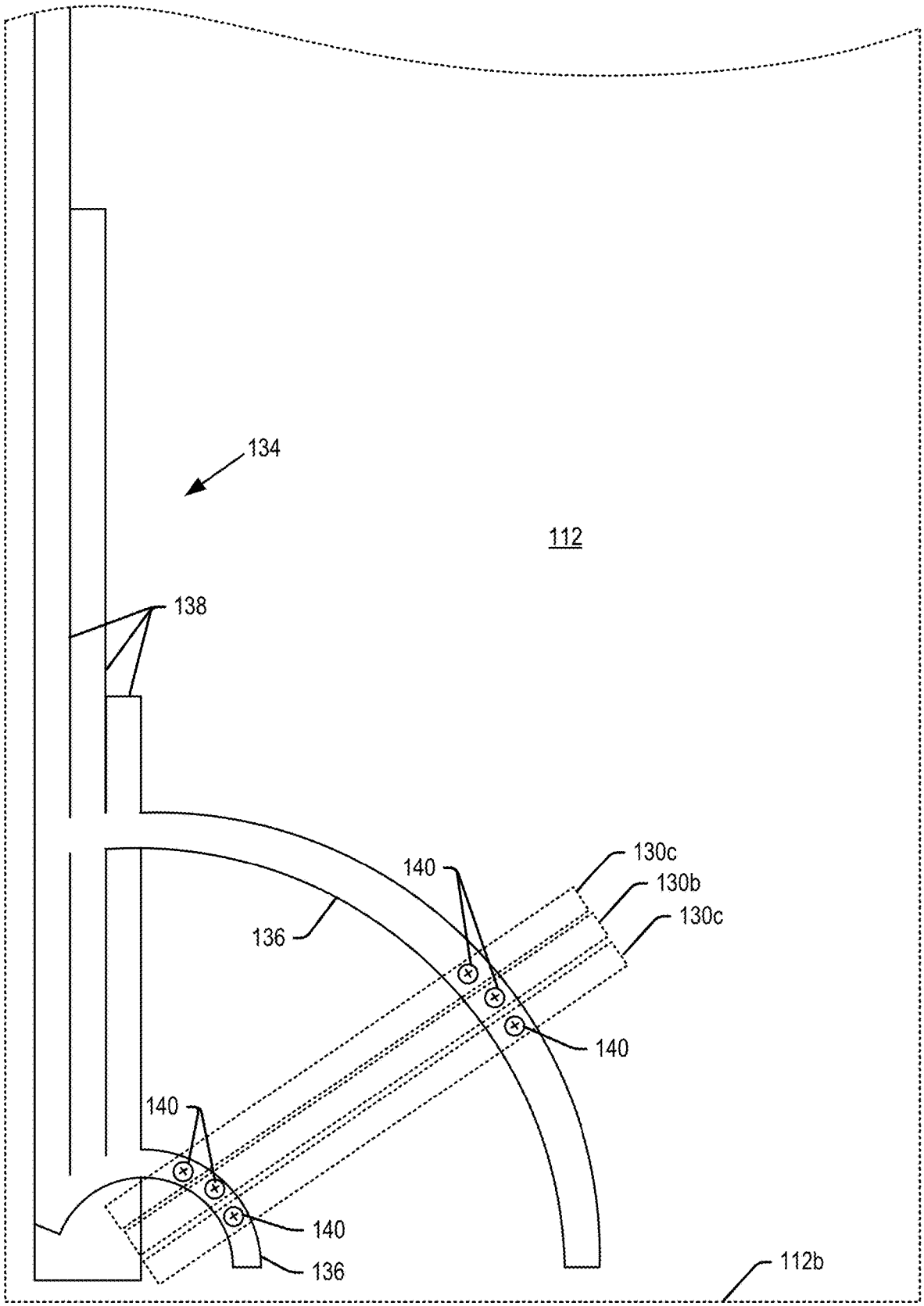
FIGS. 17-19 are plan views through the frame, showing the arcuate and linear sections of the track within which the panels are mounted.
Figure 18:
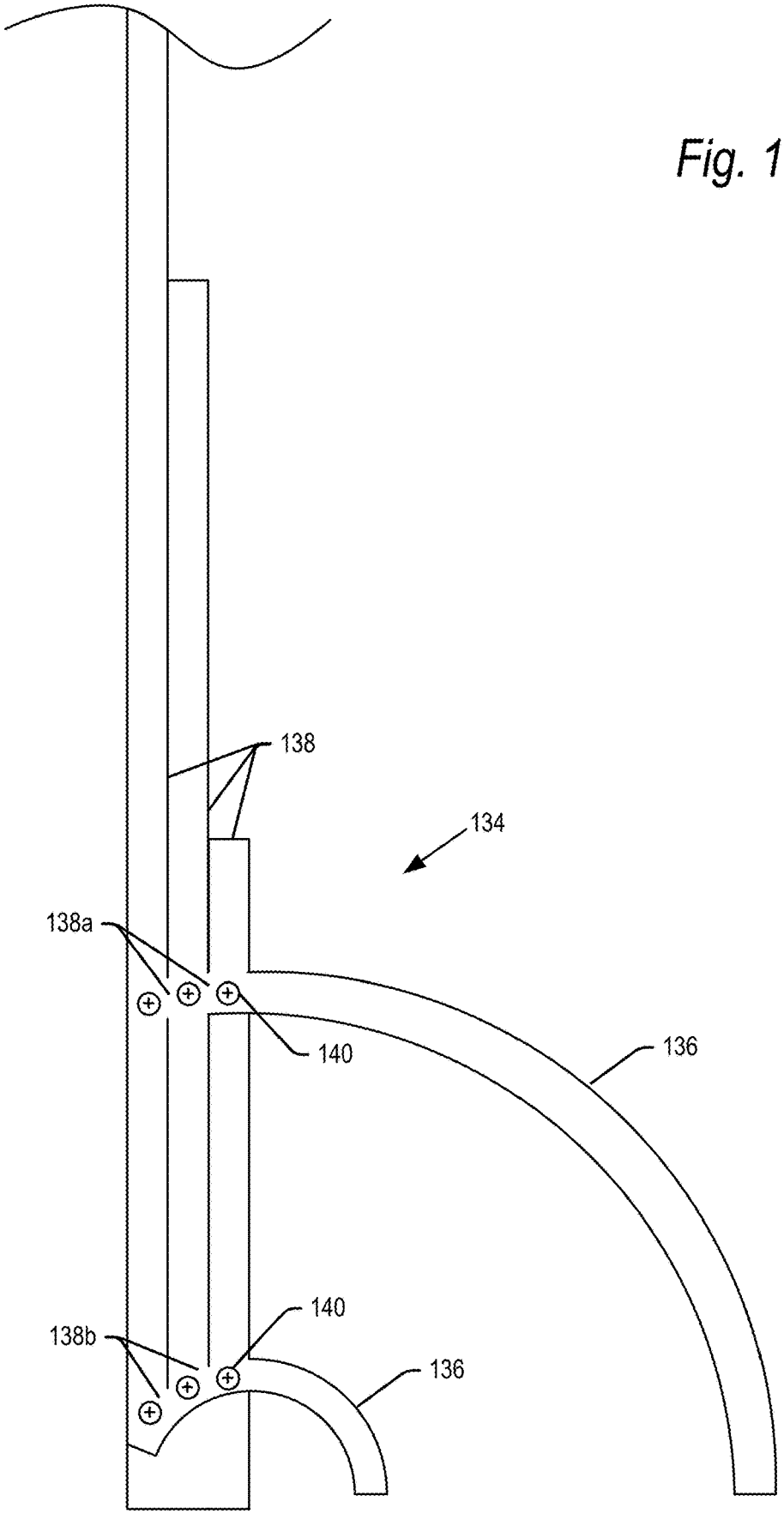
Figure 19:
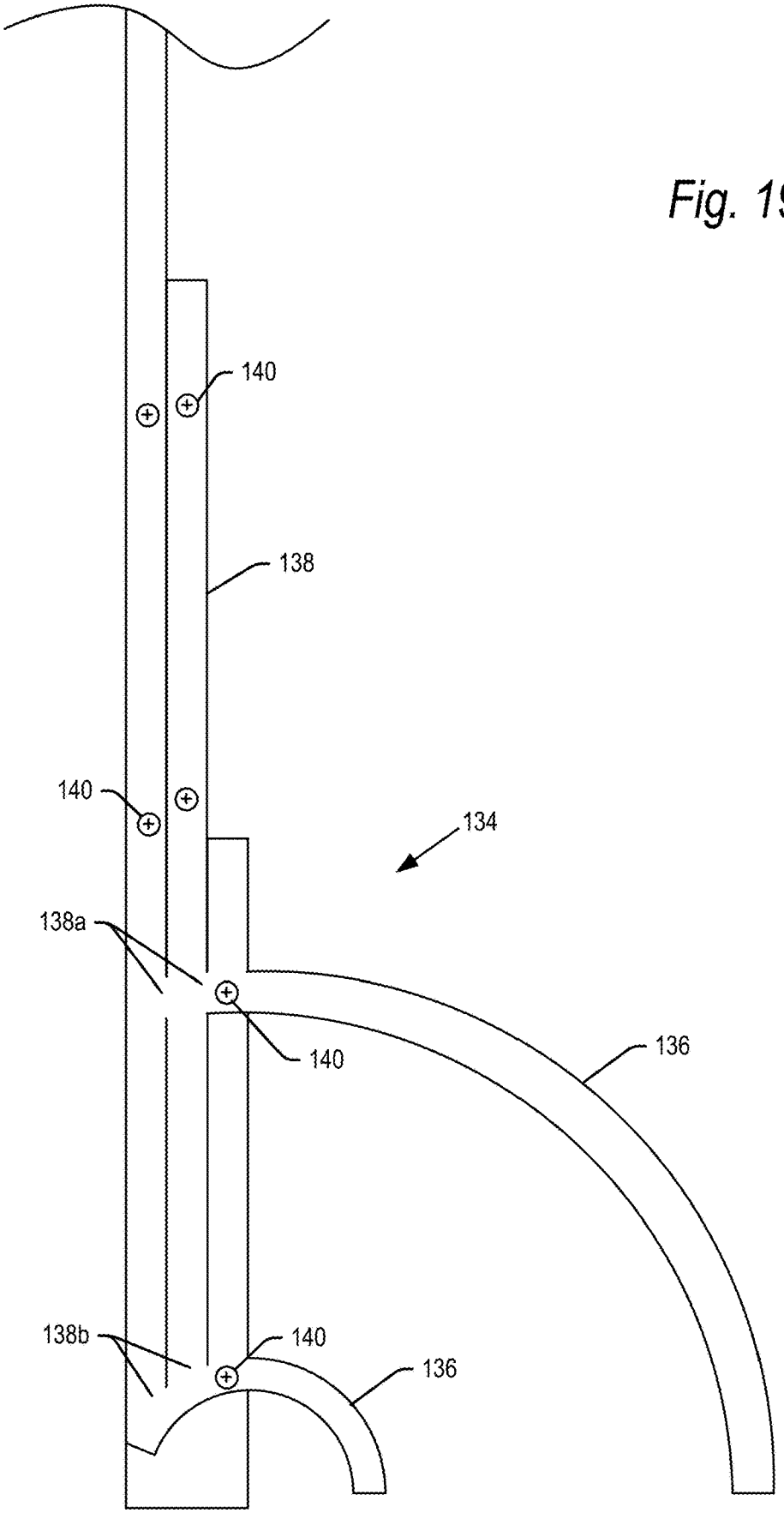
Figure 20:
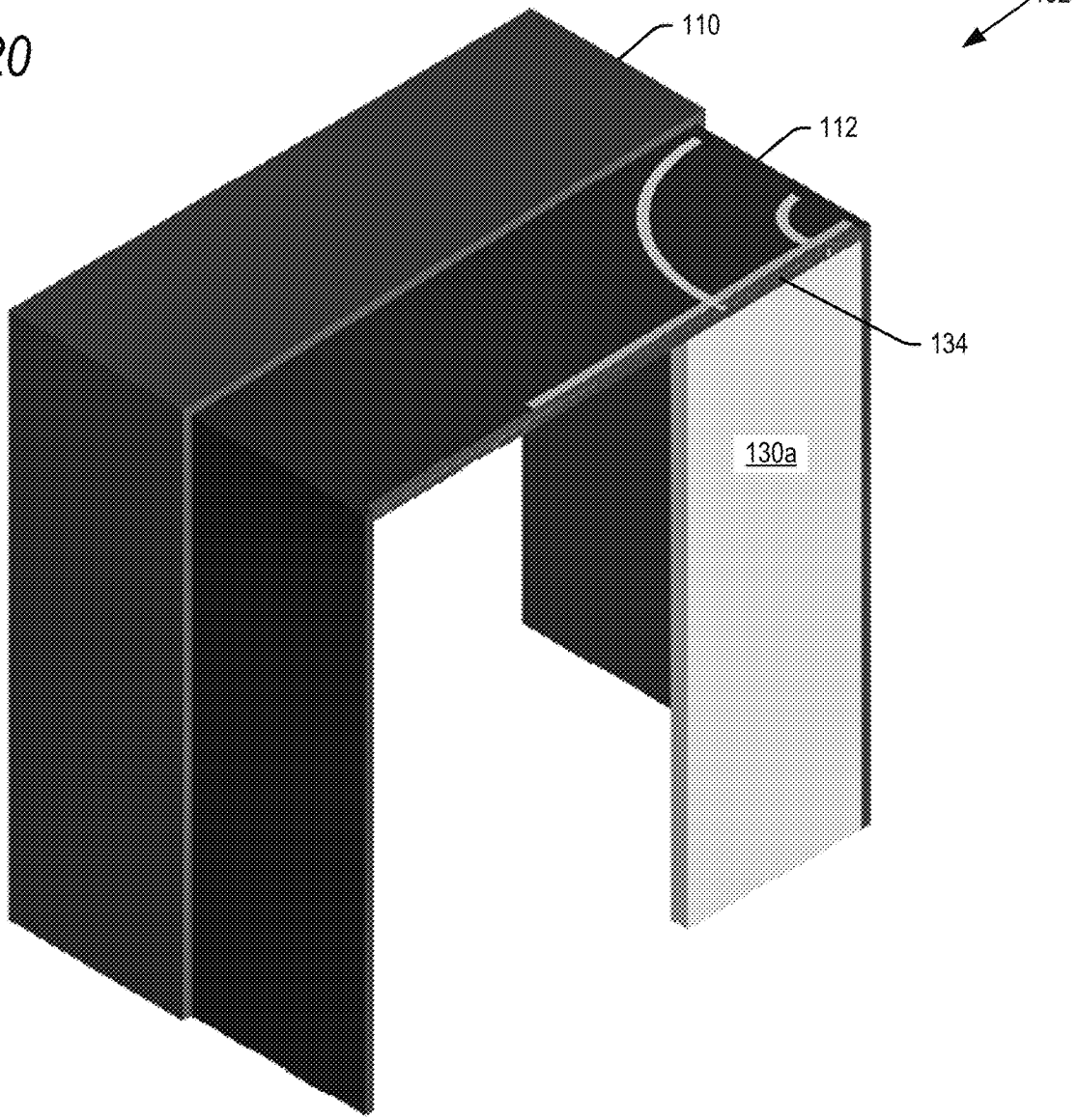
FIGS. 20-22 are perspective views showing the panels at different positions at a front portion of the frame.

As shown for example in FIGS. 15 and 16, each of the panels 130 may be supported in track 134 by a pair of pins 140, extending from a top portion of each panel. The pins 140 may extend into channels in track 134 to hold the panels within track 134 while allowing the panels to move along the arcuate and linear sections in the track 134. FIGS. 17-19 are plan views of the track 134 showing the pins 140 within the arcuate and linear sections 136, 138 as the panels 130 move within track 134. The frame 112 and panels 130 are shown in phantom in FIG. 17 and are omitted from FIGS. 18 and 19 for clarity.

In FIG. 17, the panels 130 are shown slightly rotated from their stowed position against horizontal section 112*b*. In an embodiment where each panel 130 includes a pair of pins 140, there may be a pair arcuate sections 136, with each pin 140 near a first edge of panels 130 being in a first actuate section 136, and each pin 140 near a second edge of panels 130 being in a second arcuate section 136. In an embodiment including three panels 130 (130*a*, 130*b*, 130*c*), there may be three linear sections 138, one linear section for each panel. In embodiments, the panels 130 may be constrained to rotate together along arcuate sections 136, but translate independently of each other along linear sections 138. The panels 130 may rotate independently of each other in further embodiments.

Figure 21:
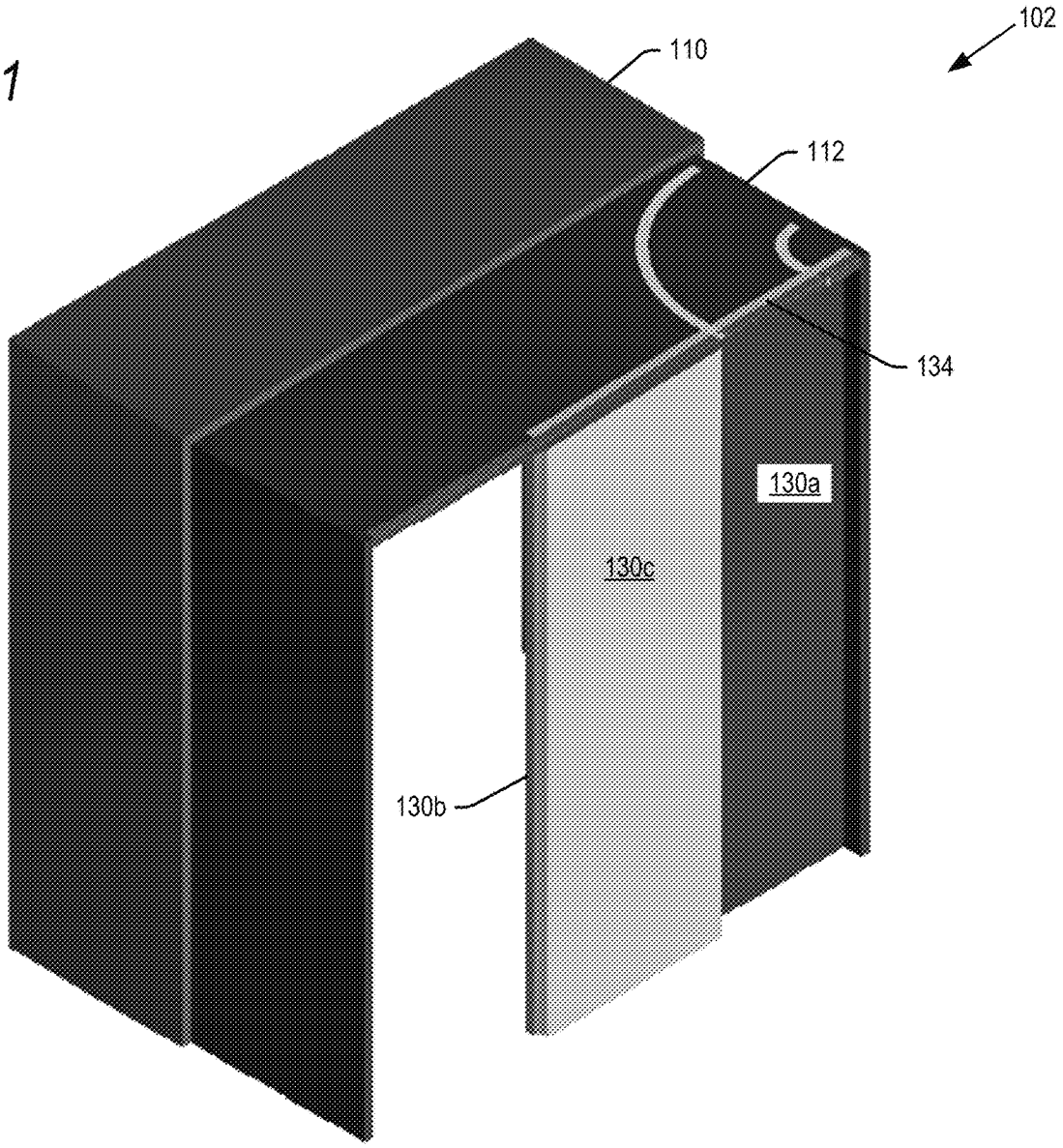
Figure 22:
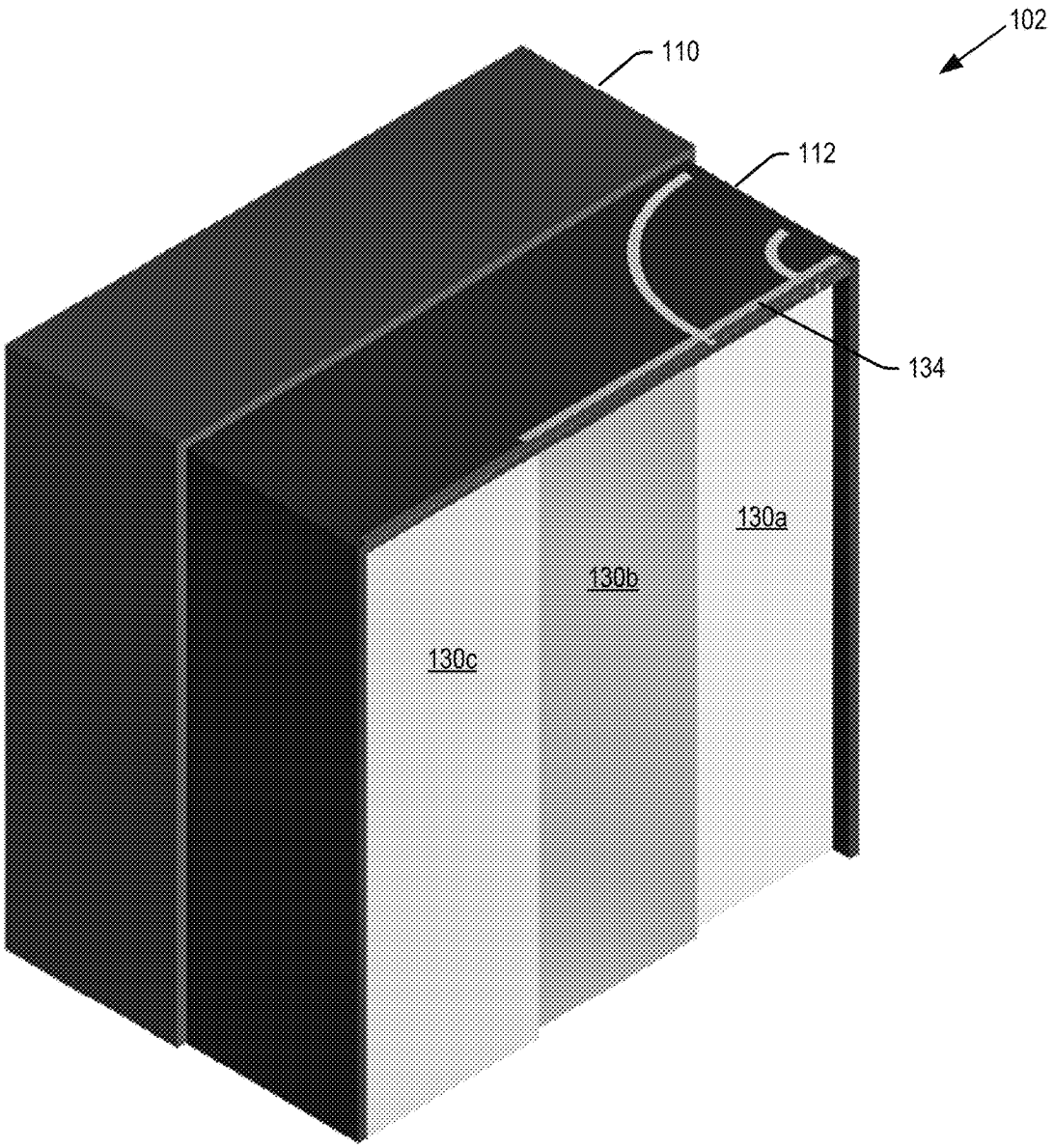

Referring for example to FIGS. 18 and 19, the linear sections 138 may have openings at 138*a* and 138*b* where the arcuate sections 136 meet up with linear sections 138. These openings allow the pins 140 to transition from rotation in the arcuate sections 136 to linear translation in the linear sections 138, and vice-versa. Thus, once the panels 130 and pins 140 are rotated out arcuate sections 136, the panels 130 and pins 140 are free to translate along linear sections 138. Once positioned in the linear sections 138, the first panel 130*a* may remain stationary (FIGS. 18 and 20), and the two remaining panels 130*b* and 130*c* may translate along the linear sections 138 (FIGS. 19 and 21). Once the second panel 130*b* has reached the limit of its travel along track 134, the third panel 130*c* may continue along track 134 to completely close off room 102 (FIG. 22).

As noted above, room 102 may include a bed 120, a cupboard 122 and/or other furniture or components in various configurations. Examples of such configurations are set forth in U.S. Pat. No. 10,577,788B1, to Zail, entitled "Reconfigurable Living Space," which patent is incorporated by reference herein in its entirety. In the embodiment shown, the room 102 may include a bed 120 having its long axis oriented against the back wall 110, as shown in the figures. This bed may for example be a twin bed, but may be a queen, king or other size beds in further embodiments. In another example, the bed 120 may have its short axis oriented against the back wall 110, and protrude out of the room 102 when frame 112 is retracted. In such an example, the bed may be cantilevered off of the two side walls of the interior wall 110 so that the end of the bed protruding from room 102 may be suspended off of the ground. The sections of frame 112 may be wide enough so that the bed 120 in this embodiment is contained entirely within the room when the frame 112 is extended and the panels 130 close off the room. Where the panels 130 are stowed and rotate outward, room may be provided between the bed 120 and panels to allow them to rotate between their stowed and extended positions.

For purposes of this document, a connection may be a direct connection or an indirect connection (e.g., via one or more other parts). In some cases, when an element is referred to as being connected or coupled to another element, the element may be directly connected to the other element or indirectly connected to the other element via intervening elements. When an element is referred to as being directly connected or coupled to another element, then there are no intervening elements between the element and the other element.

In summary, an example of the present technology relates to a living space, comprising: an area; a room adjoining the area, the room comprising: a fixed interior wall; and a frame configured to move in a first direction relative to the fixed interior wall such that the room has a first form factor when the frame is coextensive with the fixed interior wall and the room has a second, larger form factor when the frame is extended relative to the fixed interior wall.

In summary, in a further example, the present technology relates to a living space, comprising: an area; a room adjoining the area, the room comprising: a fixed interior wall, and a frame configured to move in a first direction relative to the fixed interior wall such that the room has a first form factor when the frame is coextensive with the fixed interior wall and the room has a second, larger form factor when the frame is extended relative to the fixed interior wall; a track in or on the frame; and a plurality of panels mounted for rotation and translation in the track.

The foregoing detailed description of the technology has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

I claim:

1. A living space, comprising:

an area;

a room adjoining the area, the room comprising:

a plurality of walls; and a plurality of panels configured to move between a first position where the plurality of panels and the plurality of walls together define an enclosed space within the room, and a second position where the plurality of panels stow to allow entry to and egress from the room, wherein the plurality of panels move between the first and second positions by first sliding linearly and second rotating flat against one or more of the plurality of walls.

2. The living space of claim 1, further comprising a track in a floor or ceiling, the plurality of panels configured to mount and move within the track.

3. The living space of claim 1, wherein the track comprises an arcuate section configured to allow rotation of the panels and a linear section configured to allow linear movement of at least some of the panels.

4. The living space of claim 1, wherein the plurality of walls comprise three walls, a first wall opposed to the plurality of panels when the panels are in the second position, and second and third walls extending between the first wall and the plurality of panels when the panels are in the second position.

5. The living space of claim 1, wherein the plurality of panels stow flat against at least one of the plurality of walls when in the second position.

6. The living space of claim 5, wherein at least a first panel of the plurality of panels stows flat against the second wall when the plurality of panels are in the second position, and wherein at least a second panel of the plurality of panels stows flat against the third wall when the plurality of panels are in the second position.

7. The living space of claim 5, wherein the plurality of panels are further configured to rotate outward 90 degrees from their stowed, second position when the plurality of panels are moving from the second position to the first position.

8. The living space of claim 7, wherein one or more of the plurality of panels are further configured to translate linearly after rotating outward 90 degrees from their stowed to complete their movement to the first position.

9. A living space, comprising:

an area;

a room adjoining the area, the room comprising:

a plurality of interior walls;

a track; and a plurality of panels mounted for rotation and translation in the track, the plurality of panels rotating and translating between a first position where the plurality of panels together with the plurality of interior walls define an enclosed space within the room, and a second position where the plurality of panels stow to allow entry to and egress from the room;

wherein the plurality of interior walls comprise a first wall spaced from the plurality of panels when the plurality of panels are in the first position, and a pair of side walls extending from the first wall; and wherein the plurality of panels are configured to stow against at least one of the first and second side walls to leave a front of the room uncovered when the plurality of panels are in the second position.

10. The living space of claim 9, wherein the plurality of panels stow flat against at least one of the pair of side walls when in the second position.

11. The living space of claim 10, wherein at least a first panel of the plurality of panels stows flat against a first wall of the pair of side walls when the plurality of panels are in the second position, and wherein at least a second panel of the plurality of panels stows flat against a second wall of the pair of side walls when the plurality of panels are in the second position.

12. The living space of claim 9, wherein the plurality of panels are further configured to rotate outward 90 degrees from their stowed, second position when the plurality of panels are moving from the second position to the first position.

13. The living space of claim 12, wherein one or more of the plurality of panels are further configured to translate linearly after rotating outward 90 degrees from their stowed to complete their movement to the first position.

14. The living space of claim 9, wherein the plurality of panels comprise three panels.

15. The living space of claim 9, wherein the track includes arcuate sections along which the plurality of panels rotate, and linear sections along which the plurality of panels linearly translate.

16. The living space of claim 15, further comprising a plurality of pins for mounting the plurality of panels in the track.

17. The living space of claim 16 wherein the pins are configured to move along the arcuate section to move the panels from a stowed, second position against the plurality of interior walls, and an extended position where the plurality of panels are orthogonal to the at least some of the plurality of interior walls.

18. The living space of claim 16, wherein the pins are configured to move along the linear sections, after rotating to their extended position, to close off a front of the room when the plurality of panels are in the first position.

19. A living space, comprising:

an area;

a room adjoining the area, the room comprising:

a plurality of interior walls;

a track; and a plurality of panels mounted for rotation and translation in the track, the plurality of panels rotating and translating between a first position where the plurality of panels together with the plurality of interior walls define an enclosed space within the room, and a second position where the plurality of panels stow to allow entry to and egress from the room;

wherein the track includes arcuate sections along which the plurality of panels rotate, and linear sections along which the plurality of panels linearly translate.

20. The living space of claim 19, further comprising a plurality of pins for mounting the plurality of panels in the track.

21. The living space of claim 20 wherein the pins are configured to move along the arcuate section to move the panels from a stowed, second position against the plurality of interior walls, and an extended position where the plurality of panels are orthogonal to the at least some of the plurality of interior walls.

22. The living space of claim 20, wherein the pins are configured to move along the linear sections, after rotating to their extended position, to close off a front of the room when the plurality of panels are in the first position.

* * * * *